US007093917B2

(12) United States Patent
Yamada

(10) Patent No.: US 7,093,917 B2
(45) Date of Patent: Aug. 22, 2006

(54) IMAGE FORMING APPARATUS AND CORRECTION METHOD OF TRANSFER CONDITION THEREOF

(75) Inventor: Masatoshi Yamada, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 186 days.

(21) Appl. No.: 10/670,205

(22) Filed: Sep. 26, 2003

(65) Prior Publication Data

US 2004/0066426 A1 Apr. 8, 2004

(30) Foreign Application Priority Data

Sep. 30, 2002 (JP) ..... 2002-285336

(51) Int. Cl.
*B41J 29/393* (2006.01)
*B41J 29/38* (2006.01)

(52) U.S. Cl. ..... 347/19; 347/16

(58) Field of Classification Search ..... 347/16, 347/19

See application file for complete search history.

(56) References Cited

U.S. PATENT DOCUMENTS 5,451,990 A * 9/1995 Sorenson et al. ..... 347/37
6,439,684 B1 8/2002 Yoshimura et al.
6,450,606 B1 * 9/2002 Kato et al. ..... 347/19
2001/0024284 A1 * 9/2001 Kise ..... 358/1.1
2003/0025922 A1 * 2/2003 Otsuki ..... 358/1.2
2003/0048320 A1 * 3/2003 Garcia et al. ..... 347/16
2003/0048326 A1 * 3/2003 Yamasaki et al. ..... 347/41
2004/0061767 A1 * 4/2004 Yamada ..... 347/215

FOREIGN PATENT DOCUMENTS

| | | |
|---|---|---|
| JP | 5-096796 | 4/1993 |
| JP | A 06-226964 | 8/1994 |
| JP | 8-085242 | 4/1996 |
| JP | A 11-020248 | 1/1999 |
| JP | A 2000-153660 | 6/2000 |
| JP | A 2001-001584 | 1/2001 |

* cited by examiner

*Primary Examiner*—K. Feggins
*Assistant Examiner*—Rene Garcia, Jr.
(74) *Attorney, Agent, or Firm*—Oliff & Berridge, PLC

(57) ABSTRACT

An image forming apparatus which corrects a transfer amount of a recording material without a scanner is provided. A paper is transferred to a position in which the transfer amount is adjusted by an LF roller, and a test pattern image in which a first pattern image and a second pattern image are printed in different transfer positions. Then, the paper is transferred to a position in which the transfer amount is adjusted by an exit roller, and the aforementioned test pattern image is printed. The test pattern images printed as above are used to visually observe and determine a degree of error in the amount transferred by the respective rollers. Accordingly, by receiving an input based on the printed test pattern images, it is possible to correct the transfer amount of the respective rollers.

30 Claims, 14 Drawing Sheets

IMAGE FORMING APPARATUS AND CORRECTION METHOD OF TRANSFER CONDITION THEREOF

BACKGROUND OF THE INVENTION i) Technical Field of the Invention

This invention relates to an image forming apparatus which records an image on a recording material being transferred.

ii) Description of the Related Art

In an image forming apparatus, such as an ink jet printer, which records an image on a recording material being transferred, techniques have been conventionally known in connection with correcting a transfer condition of the recording material to record the image on the recording material with high precision.

Since many of serial ink jet printers repeat a record operation in a predetermined banding width and a transfer operation of paper in turn for printing, a difference between the predetermined banding width and a transfer amount of paper may cause deterioration in image quality such as gaps or overlaps between bands in the image. The above techniques have been developed to avoid such deterioration in image quality.

For example, the Unexamined Patent Publication No. 5-96796 discloses a technique of correcting the transfer amount of the recording material according to a correction value obtained by a calculation based on a test pattern image sample read by a scanner and recorded on the recording material.

Similarly, the Unexamined Patent Publication No. 8-85242 discloses a technique of transferring the recording material under an optimal transfer condition obtained from a calculation based on a predetermined pattern image read by a scanner portion and recorded on the recording material.

However, both of the aforementioned disclosures require a scanning function for reading a test pattern image. Therefore, there is a problem that a printer without a scanning function cannot correct the transfer condition of the recording material alone.

SUMMARY OF THE INVENTION

One object of the present invention which was made to solve the above problem is to provide an image forming apparatus which corrects a transfer condition of a recording material without a scanning function, and a correction method of transfer condition thereof.

In order to attain the above object, one aspect of the present invention provides an image forming apparatus provided with a transfer unit and a record head having a plurality of record elements arranged thereon for recording dots on a recording material. The image forming apparatus forms an image based on a transfer operation that makes the transfer unit transfer the recording material and an operation that moves the record head to a direction orthogonal to a transfer direction of the recording material. The image forming apparatus further comprises a pattern generation unit, a record unit, an input unit and a correction unit. The pattern generation unit generates a predetermined test pattern image and the record unit records the test pattern image generated by the pattern generation unit on the recording material transferred by the transfer unit using the record head. A result of visual comparison between the test pattern image recorded on the recording material by the record unit and a plurality of sample images prepared based on change in the transfer condition of the transfer unit is inputted via the input unit. The correction unit corrects the transfer condition of the transfer unit based on the comparison result inputted via the input unit. Such an image forming apparatus is capable of implementing the above correction method of transfer condition It is preferable that the sample image is comprised of images expected to be obtained when the test pattern images generated by the pattern generation unit are recorded by the record unit under an optimal transfer condition of the transfer unit and under conditions different from the optimal transfer condition by predetermined values, and it is divided into a plurality of segments per transfer condition. Such a sample image allows an operator to determine how much the transfer condition of the transfer unit when the test pattern image was recorded is different from the optimal transfer condition by comparing the test pattern image with the sample image.

It is preferable that a command value indicating which of the plurality of segments in the sample image the recorded test pattern image corresponds to or falls between is inputted via the input unit, and the correction unit calculates the optimal transfer condition based on the command value to correct the transfer condition. Such a constitution allows the operator who intends to correct the transfer condition of the transfer unit to provide the command value indicating which of the plurality of segments of the sample image the recorded test pattern image corresponds to or falls between to correct the transfer condition of the transfer unit to be the optimal transfer condition.

The image forming apparatus of the present invention comprises a nonvolatile transfer condition storage unit that stores the transfer condition. In the present apparatus, the optimal transfer condition calculated by the correction unit is stored in the transfer condition storage unit. According to this constitution, it is possible to keep the transfer condition in the optimally corrected state.

It is preferable that the image forming apparatus of the present invention comprises a sample generation unit that generates the plurality of sample images based on the plurality of transfer conditions of the transfer unit. The record unit records the test pattern image generated by the pattern generation unit and the sample images generated by the sample generation unit on the recording materials transferred by the transfer unit using the record head. This constitution dispenses with safekeeping of a recording material, etc. on which the sample images are recorded.

In this case, it is further preferable that the record unit records the sample images with limiting the record elements of the record head to be used for recording or records the sample images with the transfer amount of the recording material less than normal. In this manner, the recording is less affected by the transfer condition of the transfer unit and by positions, etc. of the record elements in the record head, and the sample images can be recorded accurately.

Specifically, if the record unit records the plurality of sample images on the recording material side by side in a moving direction of the record head, a space required for recording the plurality of sample images can be minimized. That is, if the plurality of sample images are recorded side by side in the transfer direction of the recording material, for example, an elongated space in the transfer direction of the recording material will be occupied by the sample images. If a large number of sample images have to be recorded, two or more recording materials are required. The image forming apparatus of the present invention allows the plurality of sample images to be fitted and recorded within a relatively small space in the transfer direction of the recording material. Therefore, only one recording material is sufficient for the correction.

In the image forming apparatus of the present embodiment, the test pattern image recorded on the recording material by the record unit is composed of a first pattern image and a second pattern image which are recorded on the recording material one by one. Between the recordings of two pattern images, the recording material is transferred. The record unit records the first pattern image using a first part of the record elements of the record head, and records the second pattern image using a second part of the record elements which is different from the first part in position in the transfer direction of the recording material. According to such a constitution, not only the error in the amount transferred by the transfer unit but also an error in a distance between the first part and the second part in the transfer direction of the recording material are reflected in the test pattern image.

It is preferable that the first part and the second part are respective end parts of the record elements of the record head in the transfer direction of the recording material. Then, not only the error in the amount transferred by the transfer unit but also an error in the overall length of the record elements of the record head in the transfer direction of the recording material are reflected in the test pattern image. As a result, correction of the amount transferred by the transfer unit can also improve effects on the images caused by a difference in the overall length of the record elements in the transfer direction of the recording material.

The first pattern image may be the same as the second pattern image.

In the image forming apparatus of the present invention, the record elements of the record head eject ink drops to form dots on the recording material. The record control unit records the test pattern image on the recording material only when the record head is moved to one predetermined direction. According to this constitution, the test pattern image is recorded on the recording material with high precision. The ink drops ejected from the record elements on the recording material are affected by the move of the record head. Therefore, if the record head is moved to different directions during the recording without accurate correction, misalignment of dot positions may occur. Such a problem is not caused in the image forming apparatus of the present invention.

In the image forming apparatus of the present invention, the test pattern image is an image having a pattern which varies depending on the error in the amount transferred by the transfer unit. In this constitution, a positional relation between the first pattern image and the second pattern image is visually observed without difficulty.

In the image forming apparatus of the present invention, the transfer unit comprises an upstream transfer roller that transfers the recording material on an upstream side of the record head and a downstream transfer roller that transfers the recording material on a downstream side of the record head. The record unit records the test pattern image in an area of the recording material in which the recording material is transferred only by the downstream transfer roller, and the correction unit corrects the amount transferred by the downstream transfer roller. According to the above constitution, it is possible to correct the transfer condition of the downstream transfer roller. Furthermore, even in a narrow space in the transfer direction of the recording material such as the area in which the recording material is transferred only by the downstream transfer roller within the area of the recording material in which the image is formed, recording of only one test pattern image is necessary. Therefore, only one recording material is necessary and it is possible to save the recording material.

Specifically in the image forming apparatus of the present invention, the record unit records the test pattern image also in the area in which the recording material is transferred by the upstream transfer roller, and the correction unit comprises a first correction unit and a second correction unit. The first correction unit corrects the transfer condition of the upstream transfer roller based on information obtained by comparing the test pattern image recorded in the area in which the recording material is transferred by the upstream transfer roller with the sample images, and a second correction unit corrects the transfer condition of the downstream transfer roller based on information obtained by comparing the test pattern image recorded in the area in which the recording material is transferred by the downstream transfer roller with the sample images. Then, it is possible to correct the transfer condition of the upstream and downstream transfer rollers, respectively. Furthermore, it is possible to record on the same recording material the test pattern image which reflects the error in the amount transferred by the upstream transfer roller and the test pattern image which reflects the error in the amount transferred by the downstream transfer roller, and thus saving of the recording material is further enhanced.

The sample images used for comparison with the respective test pattern images may be common in both areas.

In the image forming apparatus of the present invention, the record control unit records at least two test pattern images in different phases of at least one of the transfer rollers. This constitution enables correction of the amount transferred by the transfer roller even when a rotation shaft of the transfer roller is eccentric. That is, if the rotation shaft of the transfer roller is eccentric, the transfer amount may be changed depending on the phase (rotation angle) of the transfer roller. Appropriate correction is difficult when only one test pattern image is recorded. The image forming apparatus of the present invention records two test pattern images at an interval of 180° rotation of the transfer roller or three test pattern images at intervals of 120° rotation of the transfer roller, for example, to reflect the error in the transfer amount according to the phase of the transfer roller. Consequently, the transfer amount can be appropriately corrected using an average of errors observed in the test pattern images multiply recorded, for example.

The transfer unit can be a device that is driven by a drive motor. In this case, the transfer condition corresponds to a command value to the drive motor required for transferring the recording material by a predetermined distance.

The drive motor may be a pulse motor, and the command value may be a rotation pulse number.

Another aspect of the present invention provides an image forming apparatus provided with a transfer unit and a record head having a plurality of record elements arranged thereon for recording dots on a recording material. The image forming apparatus forms an image based on a transfer operation that makes the transfer unit transfer the recording material and an operation that moves the record head to a direction orthogonal to a transfer direction of the recording material. The image forming apparatus further comprises a pattern generation unit, a sample generation unit and a record unit. The pattern generation unit generates a predetermined test pattern image and the sample generation unit generates a plurality of sample images based on a plurality of transfer conditions of the transfer unit. The record unit records the test pattern image generated by the pattern generation unit and the sample images generated by the sample generation unit on the recording material transferred by the transfer unit using the record head.

Further aspect of the present invention provides a correction method of transfer condition in an image forming apparatus. The image forming apparatus is provided with a transfer unit and a record head having a plurality of record elements arranged thereon for recording dots on a recording material. The image forming apparatus forms an image based on a transfer operation that makes the transfer unit transfer the recording material and a move operation that moves the record head to a direction orthogonal to a transfer direction of the recording material. The method comprises steps of: generating a predetermined test pattern image; recording the test pattern image generated in the pattern generation step on the recording material transferred by the transfer unit using the record head; inputting information from outside; and correcting the transfer condition of the transfer unit based on the comparison result obtained in the reception step. The transfer condition of the transfer unit is corrected in the correction step by inputting as the information a result of visual comparison between the test pattern image recorded on the recording material in the recording step and a plurality of sample images prepared based on change in the transfer condition of the transfer unit.

According to the above correction method of transfer condition, an operator who intends to correct the transfer condition of the transfer unit is allowed to visually compare the test pattern image recorded on the recording material in the recording step with the plurality of sample images to determine the transfer condition when the test pattern image was printed, and input the comparison result to correct the transfer condition of the transfer unit. Thus, a complicated mechanism such as to read the test pattern image from the recording material and calculate an error in a transfer amount of the recording material is not necessary.

BRIEF DESCRIPTION OF THE DRAWING

The invention will now be described, by way of example, with reference to the accompanying drawings, in which.

DETAILED DESCRIPTION OF PREFERRED EMBODIMENT

Figure 1:
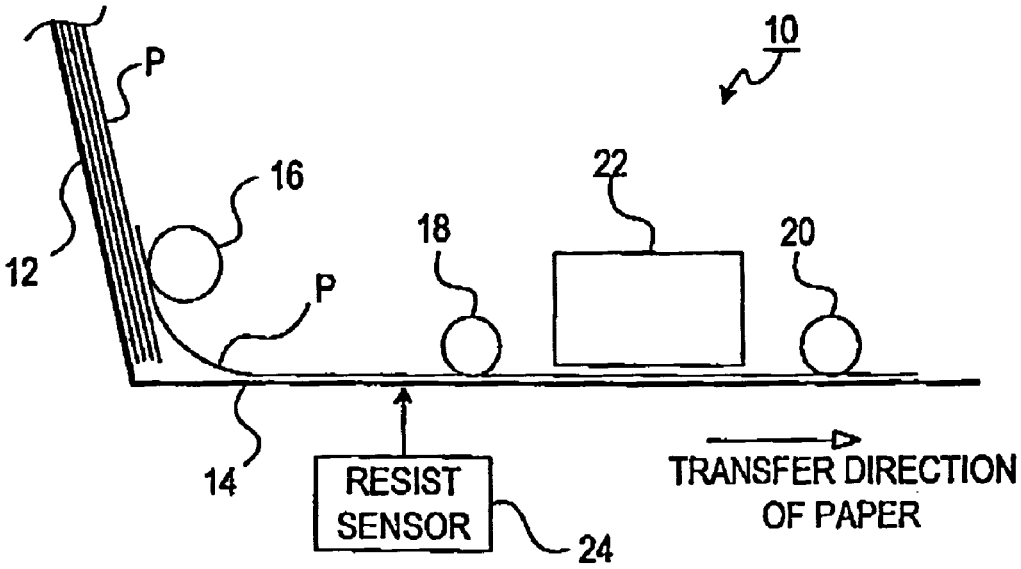
FIG. 1 is an explanatory view for describing an internal constitution of an ink jet printer of the present embodiment.

Referring to FIG. 1, an ink jet printer 10 comprises a feed roller 16, an LF roller 18, an exit roller 20, a record head 22 provided between the LF roller 18 and the exit roller 20, and a resist sensor 24. The feed roller 16 supplies a plurality of paper P loaded on a paper tray 12 to a paper transfer path 14 sheet by sheet. The LF roller 18 and exit roller 20 transfer the paper P along the paper transfer path 14. The resist sensor 24 detects a position of the transferred paper P (particularly, front and rear ends of the paper P) on an upstream side of the LF roller 18.

The LF roller 18 is provided upstream of the record head 22, and delivers the paper P transferred by the feed roller 16 to the record head 22.

The exit roller 20 is provided downstream of the record head 22, and delivers the paper P transferred passing the record head 22 onto a not shown exit tray.

Figure 2:
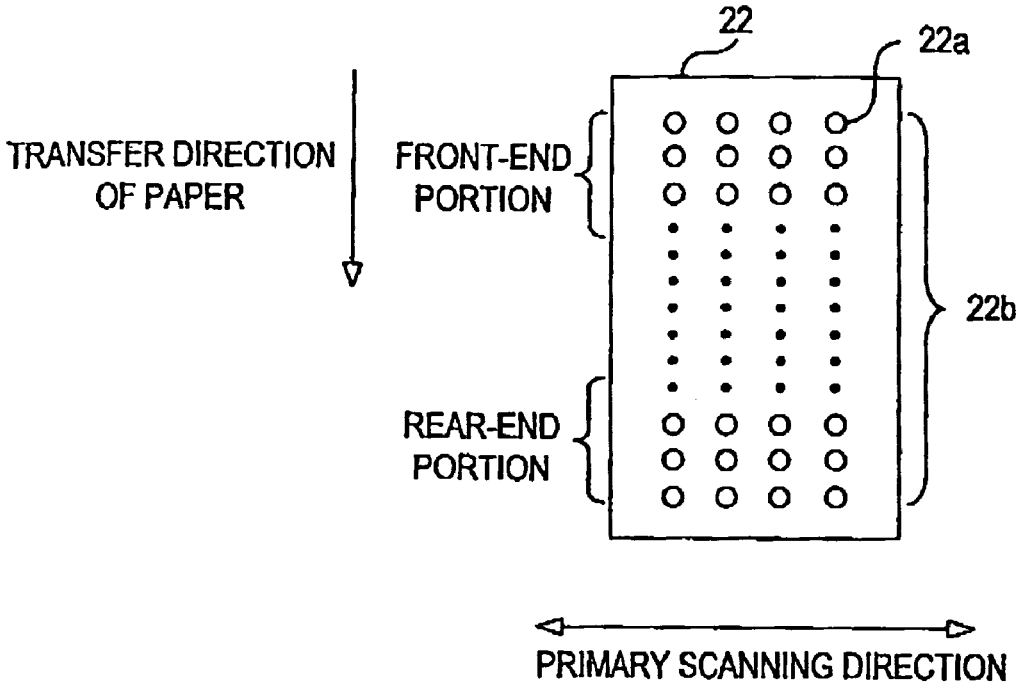
FIG. 2 is an explanatory view of a record head.

The record head 22 comprises a nozzle group 22*b* on a side of the paper P facing the paper transfer path 14. The nozzle group 22*b* is composed of a plurality of nozzles 22*a* which eject ink drops to form dots, as shown in FIG. 2. The nozzle group 22*b* comprises four rows of nozzles lined up in a transfer direction of the paper P. Each row of the nozzles ejects ink drops of different colors (black, cyan, yellow and magenta).

The record head 22 is mounted on a not shown carriage which travels back and forth on a surface of the delivered paper P in a direction orthogonal (primary scanning direction) to the transfer direction (secondary scanning direction) of the paper P. The record head 22 moves along with the carriage.

Figure 3:
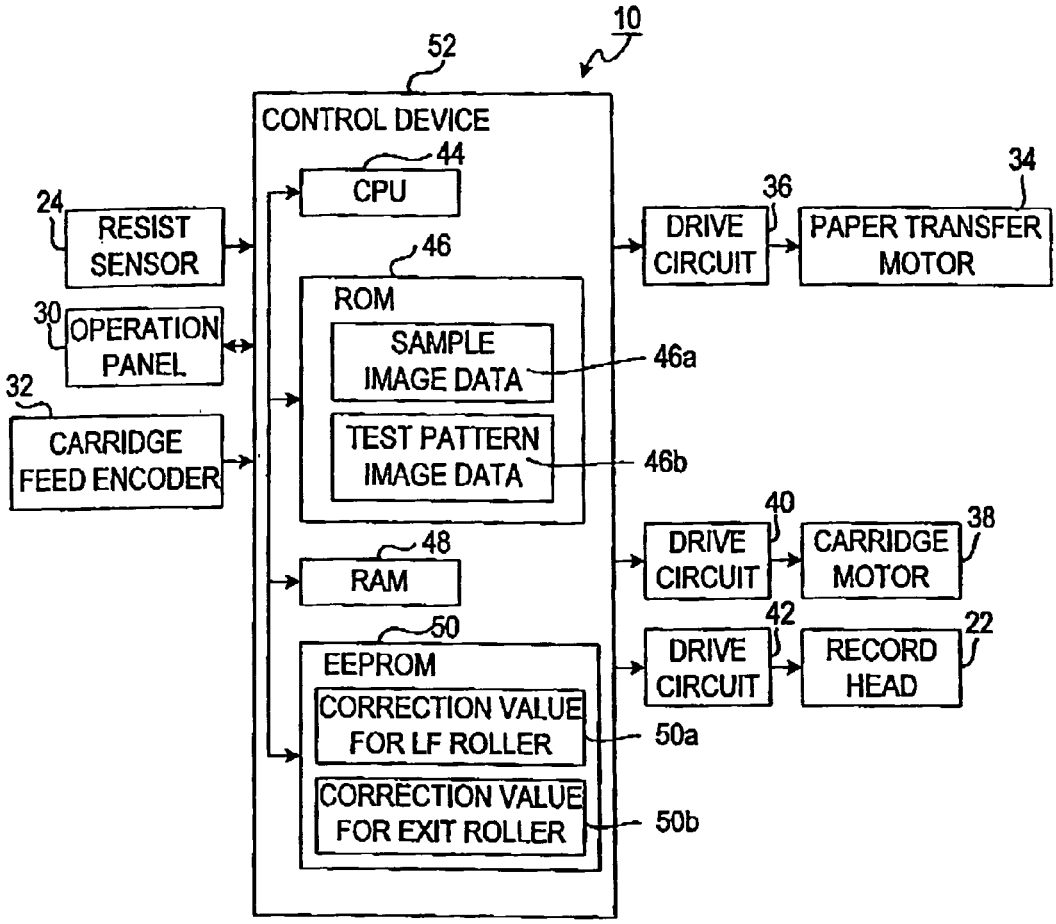
FIG. 3 is a block diagram showing an electrical constitution of the ink jet printer.

Now, an electrical constitution of the ink jet printer 10 is described by way of FIG. 3.

As shown in FIG. 3, the ink jet printer 10 comprises the aforementioned resist sensor 24, an operation panel 30, a carriage feed encoder 32, a paper transfer motor (pulse motor) 34, a drive circuit 36, a carriage motor 38, a drive circuit 40, the aforementioned record head 22, a drive circuit 42, and a control device 52 that includes known CPU 44, ROM 46, RAM 48 and EEPROM 50. The operation panel 30 is provided with keys for accepting an input from outside and a display for displaying a message, etc. to the outside. The carriage feed encoder 32 detects a position of the carriage. The paper transfer motor 34 rotates the feed roller 16, LF roller 18 and exit roller 20 by a rotation amount corresponding to an inputted pulse rotation number. The drive circuit 36 activates the paper transfer motor 34, the carriage motor 38 moves the carriage back and forth, the drive circuit 40 activates the carriage motor 38, and the drive circuit 42 makes the desired nozzle 22*a* in the nozzle group 22*b* eject an ink drop.

The control device 52 performs a print process for printing (forming) a desired image on the paper P, based on an operation of ejecting ink drops while moving the record head 22 in the primary scanning direction and an operation of transferring the paper P by a predetermined transfer amount intermittently.

The transfer amount of the paper P during the printing process is defined by a rotation amount of the LF roller 18 or exit roller 20. Especially, when the paper P is in a position capable of being transferred by both of the LF roller 18 and exit roller 20, the transfer amount of the paper P is defined by the rotation amount the LF roller 18. The exit roller 20 is only allowed to define the transfer amount of the paper P after the rear end of the paper P comes out of the LF roller 18.

Figure 10:
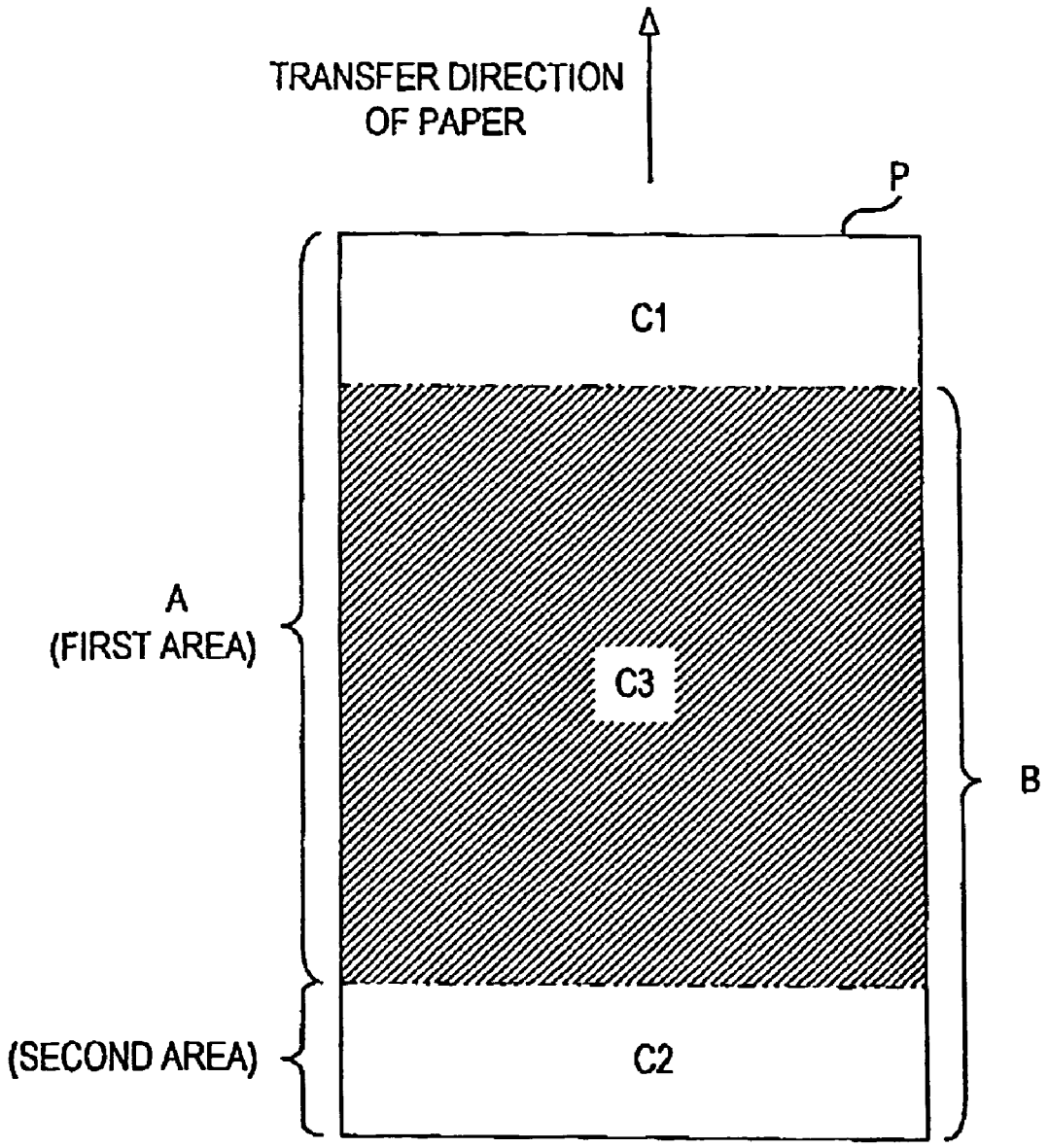
FIG. 10 is an explanatory view showing a space on a paper in which an image is printed.

That is, as shown in FIG. 10, there exist an area A in which the LF roller 18 transfers the paper P (area in which the paper P is capable of being transferred by the LF roller 18) and an area B in which the exit roller 20 transfers the paper P (area in which the paper P is capable of being transferred by the exit roller 20) in a space on the paper P in which the image is printed. These areas partially overlap with each other. Thereby, the space on the paper P in which the image is printed is divided into three areas, that is, an area C1 in which the paper P is transferred only by the LF roller 18 (front-end area of the paper P in the transfer direction), an area C2 in which the paper P is transferred by only the exit roller 20 (rear-end area of the paper P in the transfer direction), and an area C3 in which the paper P is transferred by both of the LF roller 18 and exit roller 20 (center area of the paper P in the transfer direction) C3. Among the above areas, the area C1 in which the paper P is transferred by the LF roller 18 and the area C3 in which the paper P is transferred by both of the LF roller 18 and exit roller 20 constitute an area in which the transfer amount of the paper P is determined by the LF roller (hereinafter, referred to as a first area), and the area in which the paper P is transferred only by the exit roller 20 constitutes an area in which the transfer amount of paper P is determined by the exit roller 20 (hereinafter, referred to as a second area). The second area is an area in the rear end of the paper P which occupies nearly the same length of space as a distance between the LF roller 18 and the exit roller 20. Accordingly, the second area is narrow in the secondary scanning direction compared to the first area occupying the remaining space of the paper P.

The control device 52, when it makes the LF roller 18 and exit roller 20 transfer the paper P, provides the transfer amount (rotation pulse number) to the drive circuit 36. The drive circuit 36 activates the paper transfer motor 34 in such a way that the LF roller 18 and exit roller 20 are rotated at an angle which corresponds to the transfer amount (hereinafter, referred to as a reference transfer amount) provided by the control device 52.

At this time, the control device 52 does not directly set an amount of the paper P to be transferred (hereinafter, referred to as a target transfer amount) to the reference transfer amount, but transfers out a transfer amount correction process which sets a corrected target transfer amount to the reference transfer amount. Particularly, a correction value 50*a* for LF roller 18 for correcting the transfer amount of the LF roller 18 and a correction value 50*b* for exit roller 20 for correcting the transfer amount of the exit roller 20 are stored in the EEPROM 50. Each of the respective correction values represents a correction transfer amount (correction pulse number) required per unit transfer amount. The control device 52 provides to the drive circuit 36 a value obtained by correcting the target transfer amount with the correction value 50*a* for LF roller 18 as the reference transfer amount when it makes the LF roller 18 transfer the paper P, and provides to the drive circuit 36 a value obtained by correcting the target transfer amount with the correction value 50*b* for exit roller 20 as the reference transfer amount when it makes the exit roller 20 transfer the paper P. The correction values 50*a* and 50*b* for LF roller 18 and exit roller are initially set to 0.

Figure 4:
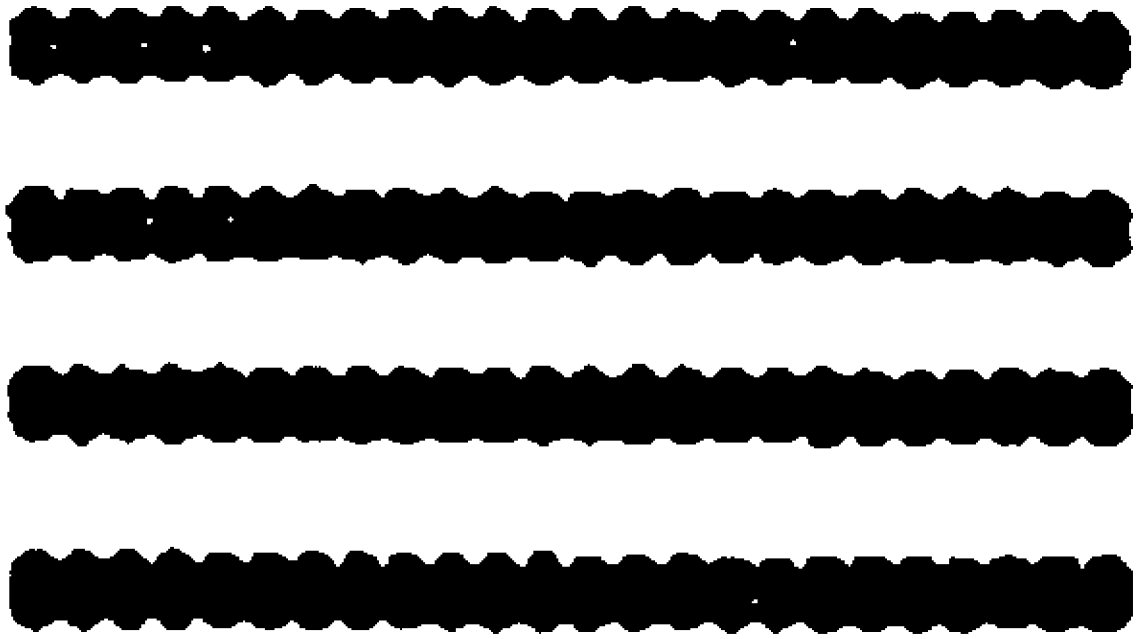
FIG. 4 is an explanatory view of a test pattern image.

The ink jet printer 10 prints a test pattern image on the paper P as shown in FIG. 4, when a predetermined input operation for printing the test pattern image on the paper P (hereinafter, referred to as a test pattern print operation) is conducted by way of the input keys on the operation panel 30. FIG. 4 is an emphatic view of the actual test pattern image.

Figure 5:
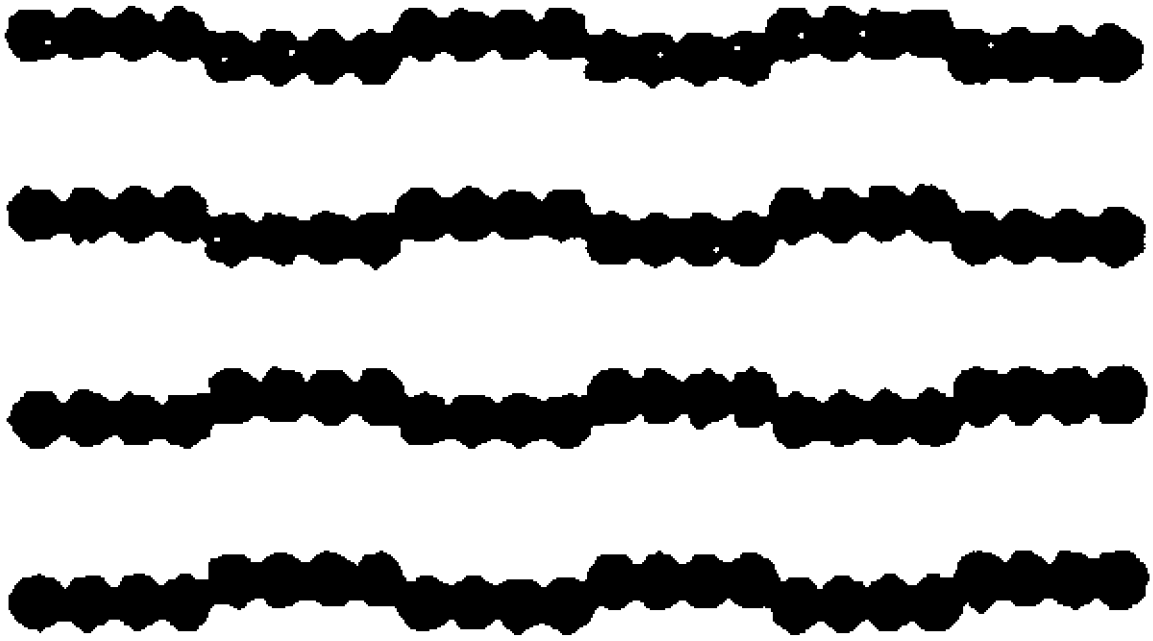
FIG. 5 is an explanatory view of a first pattern image.
Figure 6:
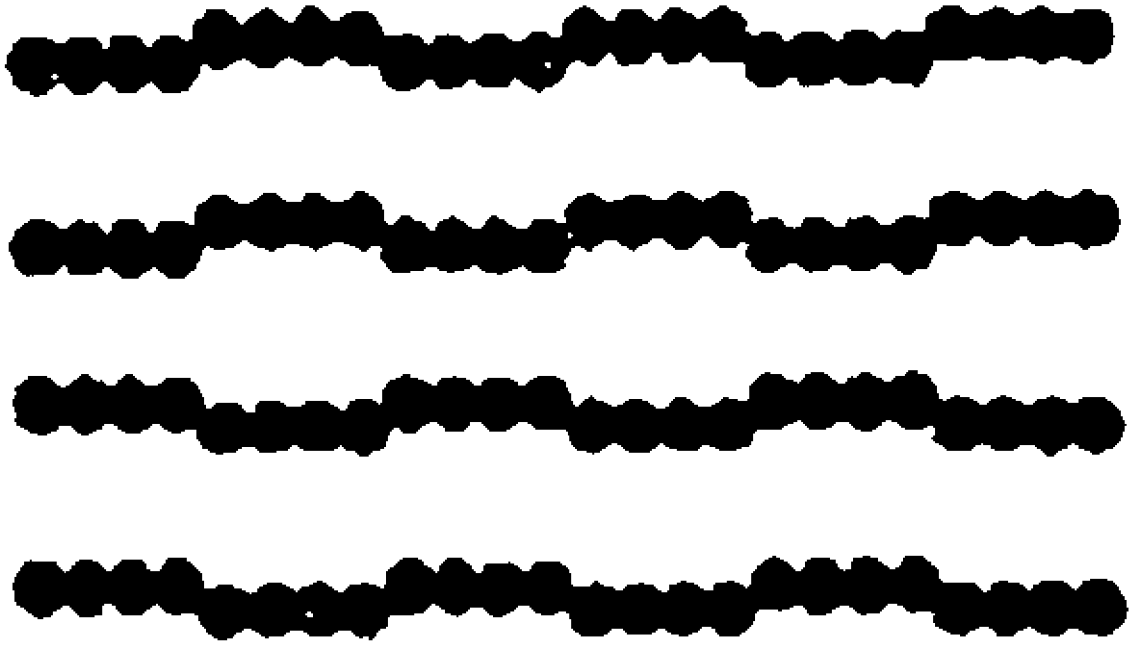
FIG. 6 is an explanatory view of a second pattern image.

Here, the test pattern image is composed of a first pattern image as shown in FIG. 5 and a second pattern image as shown in FIG. 6. In the test pattern image, the first and second pattern images are printed with different transfer amounts of the paper P. A pattern which appears in the printed test pattern image varies depending on a positional relation between the first pattern image and the second pattern image. Accordingly, the error in the transfer amount by the LF roller 18 is reflected on the test pattern image printed in the first area of the paper P, and the error in the transfer amount by the exit roller 20 is reflected in the second area of the paper P. The first and second pattern images are shown enlarged in FIGS. 5 and 6, respectively, for the sake of easy understanding.

Figure 7:
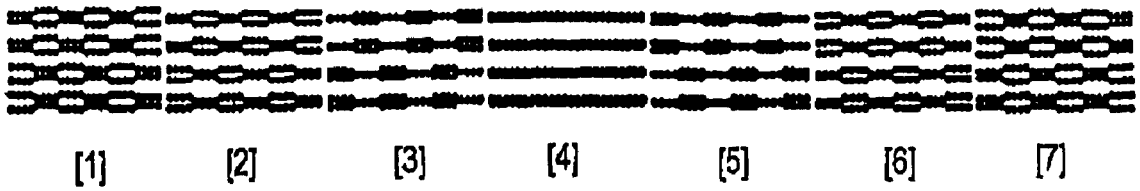
FIG. 7 is an explanatory view of sample images.

In the present embodiment, a sample document (prepared in advance) in which seven sample images sequentially numbered from [1] to [7] are printed as shown in FIG. 7 is used, and a degree of error in the transfer amount is determined by comparing the test pattern image printed on the paper P with the sample images.

That is, the above seven sample images are the test pattern images disposed at predetermined intervals in which the positional relations between the first pattern image and the second pattern image in the secondary scanning direction are gradually different from each other. They are printout images (predetermined printout images) when the test pattern images are printed under an optimal transfer condition and conditions different from the optimal transfer condition by predetermined values. In the present embodiment, the sample image [4] in the middle corresponds to the image when the test pattern image is printed on the optimal transfer condition. Other sample images correspond to the images printed when the transfer amount is more than that of the optimal transfer condition (i.e. [1] to [3]) or when the transfer amount is less than that of the optimal transfer condition (i.e. [5] to [7]).

Accordingly, if the transfer amount of the paper P at the time the test pattern image is printed is appropriate (on the optimal transfer condition), the image corresponding to the sample image [4] is obtained. If the transfer amount of the paper P is less than that of the optimal transfer condition, the image corresponding to the sample images [1] to [3] is obtained depending on the short amount, and if the transfer amount of the paper P is more than that of the optimal conditions, the image corresponding to the sample images [5] to [7] is obtained depending on the excess amount.

Figure 8:
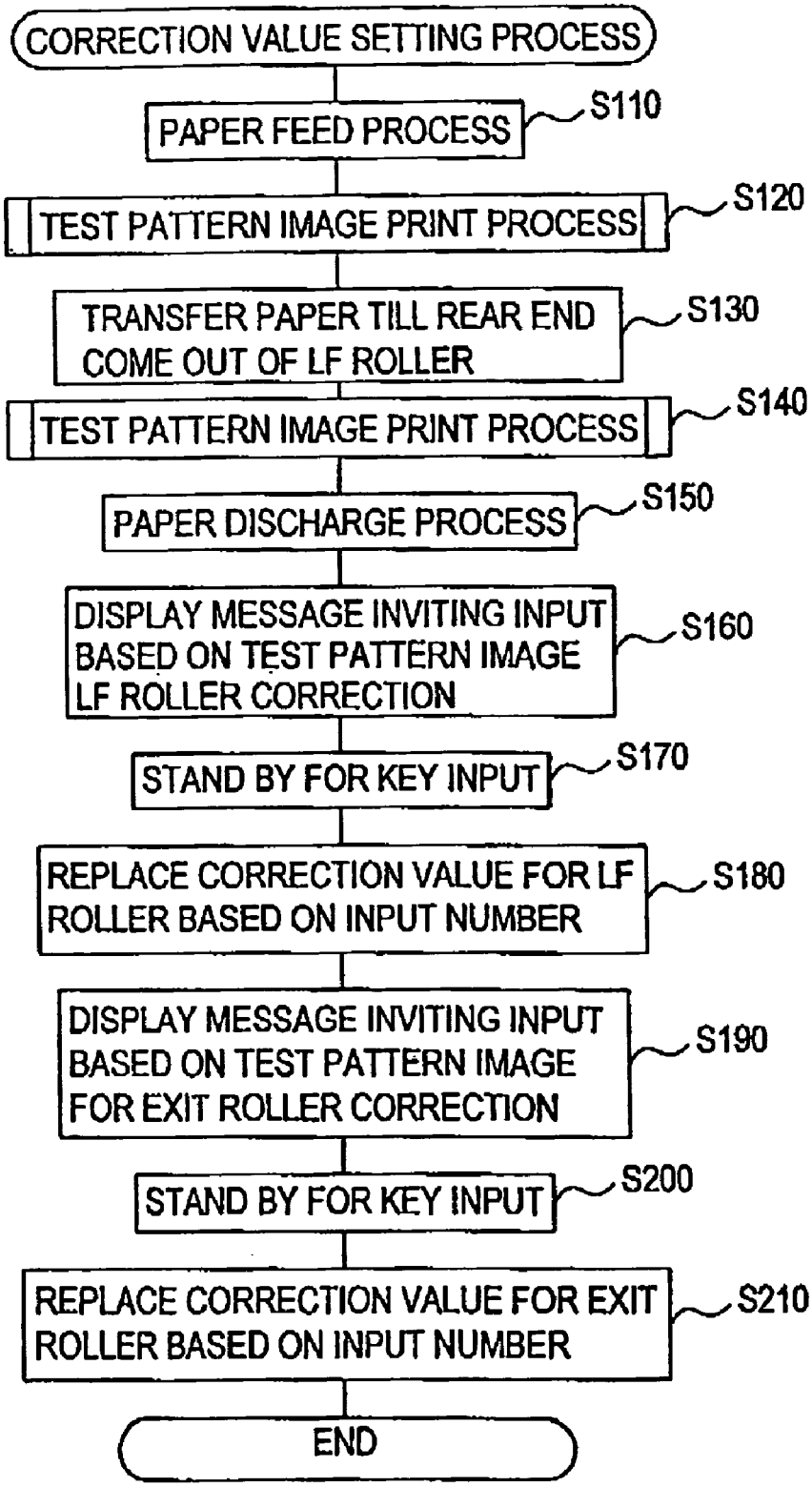
FIG. 8 is a flowchart of a correction value setting process.

Next, a correction value setting process performed by the CPU 44 of the control device 52 is explained by way of a flowchart of FIG. 8. In the correction value setting process, the above test pattern image is printed on the paper P and the transfer amount of the paper P is adjusted to an optimal value. The correction value setting process is started when a predetermined input operation is performed.

When this correction value setting process is started, the CPU 44 rotates the respective rollers 16, 18, 20 to transfer the paper P on the paper tray 12 to a position in which the test pattern image can be printed in the first area, in step S110.

In step S120, the CPU 44 executes a test pattern print process for printing the test pattern image in the first area of the paper P. Detailed description of this test pattern print process will follow later.

In step S130, the CPU 44 rotates the respective rollers 18, 20 to transfer the paper P to a position in which the test pattern image can be printed in the second area (position in which the rear end of the paper P comes out of the LF roller 18).

In step S140, the CPU 44 executes the test pattern image print process for printing the test pattern image in the second area of the paper P, as in S120.

In step S150, the CPU 44 rotates the exit roller 20 to transfer the paper P onto the not shown exit tray. As a result, the paper P on which two test pattern images spaced in the secondary scanning direction are printed is discharged. That is, a test pattern image is printed in the first and second areas of the paper P, respectively.

In step S160, a message which invites an input of the number of the sample image which most closely resembles the test pattern image printed in the first area of the paper P in step S120 (test pattern image reflecting the error of the transfer amount of the LF roller 18) is displayed on the display of the operation panel 30. Since two test pattern images are printed on the paper P, it is preferable that a legend as well is printed on the paper, which indicates that the test pattern image in the first area printed in step S120 is for correction of the LF roller 18 and that the test pattern image in the second area printed in step S140 is for correction of the exit roller 20, so that the respective test pattern images can be distinguished from each other.

In step S170, the CPU 44 stands by until the input by an operator using the input keys of the operation panel 30 is received. When the CPU 44 receives the input, the process moves to step S180 and the correction value 50*a* for LF roller 18 stored in the EEPROM 50 is replaced with an optimal value based on the inputted number. That is, as mentioned above, if there is an error (over and short) in the transfer amount of the paper P when the test pattern image is printed, the pattern which appears in the test pattern image varies depending on the degree of error. Therefore, it is possible to determine the degree of error in the transfer amount based on the number of the sample image which most closely resembles the test pattern image, and set the optimal correction value based on the inputted number.

In step S190, as is the case with step S160, a message which invites an input of the number of the sample image which most closely resembles the test pattern image printed in the second area of the paper P in step S140 (test pattern image reflecting the error of the transfer amount of the exit roller 20) is displayed on the display of the operation panel 30.

In step S200, the CPU 44 stands by until the input by the operator using the input keys of the operation panel 30 is received. When the CPU 44 receives the input, the process moves to step S210 and the correction value 50*b* for exit roller 20 stored in the EEPROM 50 is replaced with an optimal value based on the inputted number.

Figure 9:
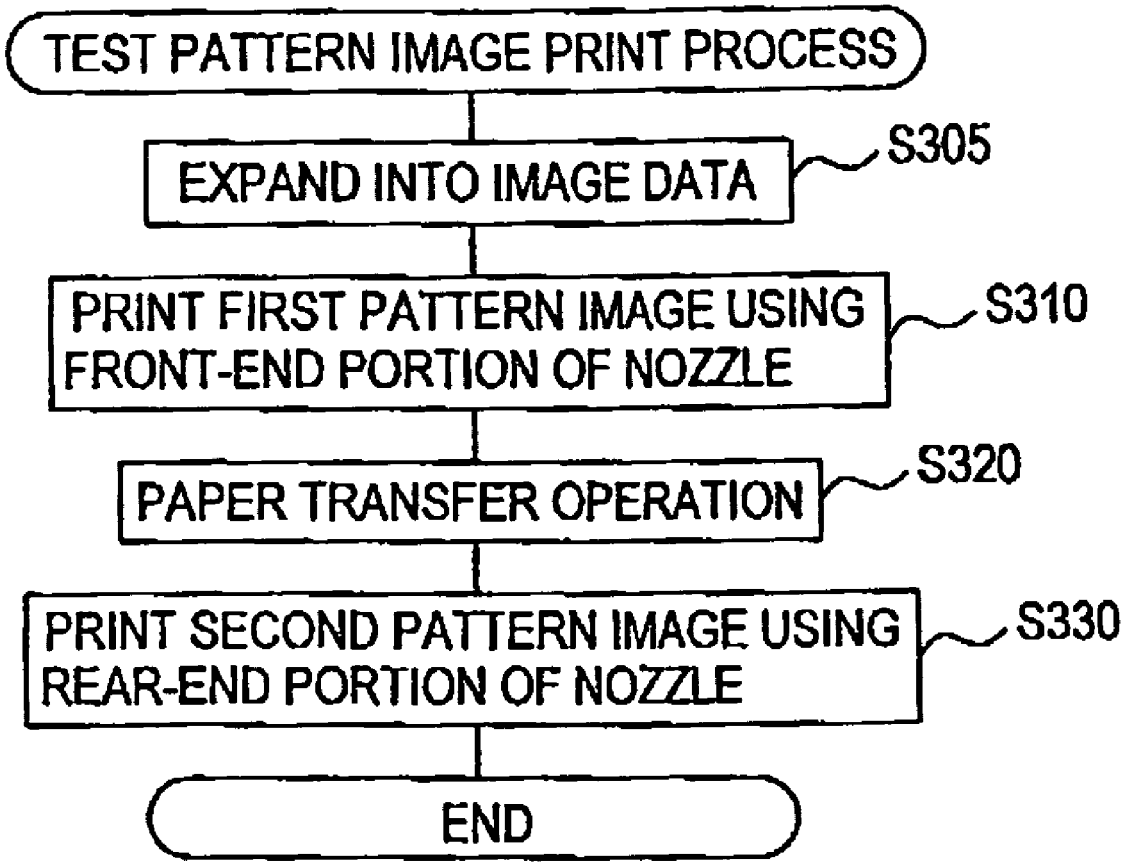
FIG. 9 is a flowchart of a test pattern image print process.

Next, the test pattern image print process executed in steps S120 and S140 of the aforementioned correction value setting process is explained by way of a flowchart of FIG. 9.

When this test pattern image print process is started, the test pattern image data 46*b* stored in the ROM 46 is read to expand the test pattern image to be printed on the paper P (first pattern image and second pattern image, in particular) into image data.

In step S310, based on the image data expanded in step S305, the CPU 44 activates the record head 22 and carriage motor 38 to print the first pattern image (FIG. 5) on the paper P. Here, the printing of the first pattern image is performed using a portion on the upstream side in the transfer direction (hereinafter, referred to as a front-end portion) of the nozzle group 22*b* of the record head 22. In the present embodiment, a black ink is used when the test pattern image is printed. However, inks of other colors can be also used as long as they can be identified visually.

In step S320, the paper P is transferred by a distance corresponding to "nozzle length-print width". The nozzle length represents a length of the nozzle group 22*b* in the transfer direction of the paper P, that is, a distance between the nozzles 22*a* on both ends of the respective rows of the nozzles.

In step S330, the CPU 44 drives the record head 22 and carriage motor 38 to print a second pattern image (FIG. 6) on the paper P, and ends the test pattern image print process. The printing of the second pattern image is performed using a portion on the downstream side in the transfer direction (hereinafter, referred to as a rear-end portion) of the nozzle group 22*b* of the record head 22. Here, the moving direction of the record head 22 when the second pattern image is printed on the paper P is set to be the same moving direction of the record head 22 when the first pattern image was printed on the paper P in step S310 (for example, direction from left to right). A print position of the second pattern image in the primary direction is set to the position of the first pattern image printed in step S310. The length of the rear-end portion of the nozzle group 22*b* which prints the second image in the transfer direction of the paper P, that is, the distance between the nozzles 22*a* on both ends in the rear-end portion used to print the second image is the same as the above print width.

Next, a function of the ink jet printer 10 is described.

When the operator who intends to correct the error in the transfer amount of the LF roller 18 and exit roller 20 executes the predetermined test pattern print operation using the input keys on the operation panel 30, a test pattern image is printed in each of the first and second areas on the paper P (S110–150). Then, the message for making the operator input the number of the test pattern image which most closely resembles the test pattern image for LF roller correction is displayed on the display of the operation panel 30 in the ink jet printer 10 (S160).

The operator compares the test pattern image for LF roller correction printed on the paper P with the sample images, determines which sample image most closely resembles the test pattern image, and inputs the corresponding number using the input keys on the operation panel 30. In the ink jet printer 10, the correction value 50*a* for LF roller 18 stored in the EEPROM 50 is replaced with the optimal value based on the inputted number (S170, S180).

Subsequently, in the ink jet printer 10, the message for making the operator input the number of the sample image which most closely resembles the test pattern image for exit roller correction is displayed on the display of the operation panel 30 (S190).

Similarly, the operator observes and determines which sample image most closely resembles the test pattern image for exit roller correction printed on the paper P, and inputs the corresponding number using the input keys on the operation panel. In the ink jet printer 10, the correction value 50*b* for exit roller 20 stored in the EEPROM 50 is replaced with the optimal value based on the inputted number (S200, S210).

Thereby, in the print process hereafter, the transfer amount correction process is transferred out using the correction values after the replacement.

As in the above, the ink jet printer 10 of the present embodiment ensures correction of the transfer amount of the paper P without an image read apparatus such as a scanner. Since only one test pattern image is required to be printed to observe the error in the amount transferred by the respective rollers 18, 20, a large space is not necessary for the printing. Especially, in the present embodiment, since the test pattern images for exit roller correction and LF roller correction are printed on the same sheet of paper P, saving of paper is further enhanced.

Moreover, it is easy to observe and determine the degree of misalignment since the pattern of the test pattern image varies depending on the degree of gap or overlap between the first and second pattern images.

Since the test pattern image is printed using the front-end and rear-end portions of the nozzle group 22*b*, the correction of the transfer amount can be done taking into account the error in the nozzle length as well.

Also, since the moving directions of the record head 22 are the same when the first and second pattern images are printed respectively, the precision of printing the test pattern image is improved.

In the above, one embodiment of the present invention has been described. However, other modifications and variations may be possible without departing from the technical scope of the invention.

For instance, in the ink jet printer 10 of the above embodiment, the test pattern printed on the paper P is compared with the plurality of sample images printed on a sample paper prepared in advance. However, it is further preferable that the plurality of sample images are printed together with the test pattern image when the test pattern image is printed on the paper P. Then, it is not necessary to keep the sample paper.

Figure 14:
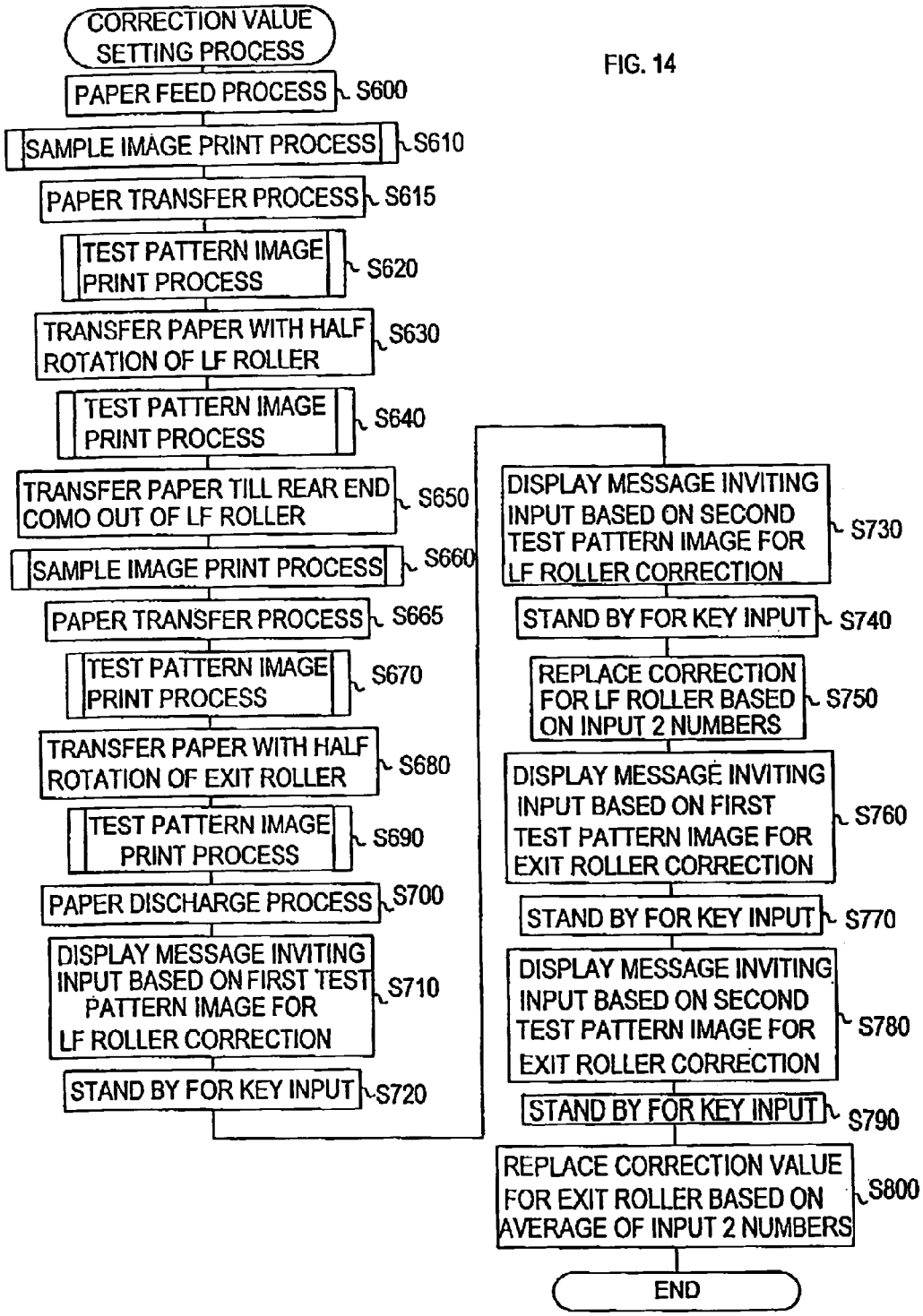
FIG. 14 is a flowchart of the correction value setting process when the test pattern image is printed in different phases of rollers.

Particularly, a correction value setting process shown in FIG. 14 is executed instead of the correction value setting process (FIG. 8) of the above embodiment.

That is, when this correction value setting process is started, the CPU 44 rotates the respective rollers 16, 18, 20 to transfer the paper P on the paper tray 12 to a position in which the test pattern image can be printed in the first area in step S400.

In step S410, a sample image print process for printing the sample images in the first area of the paper P is executed. Detailed description of this sample image print process will follow later.

In step S415, the CPU 44 rotates the respective rollers 18, 20 to transfer the paper P by a predetermined amount (as much amount as to create an interval between the sample images and the test pattern image), and in step S420, executes the aforementioned test pattern image print process (FIG. 9) for printing the test pattern image in the first area of the paper P.

In step S430, the CPU 44 rotates the respective rollers 18, 20 to transfer the paper P to a position in which the test pattern image can be printed in the second area (position in which the rear end of the paper P comes out of the LF roller 18).

In step S440, the CPU 44 executes the sample image print process in the second area of the paper P, as in step S410.

In step S445, the paper P is transferred by a predetermined amount (as much amount as to create an interval between the sample images and the test pattern image), and in step S460, the CPU 44 executes the aforementioned test pattern image print process for printing the test pattern image in the second area of the paper P, as in step S420.

In step S460, the CPU 44 rotates the exit roller 20 to transfer the paper P onto the not shown exit tray. As a result, the paper P on which two sets of sample images and two test pattern images spaced in the secondary scanning direction are printed is discharged. That is, one set of sample images and a test pattern image are respectively printed in the first area and in the second area of the paper P.

It is essential that the same images are always reproduced (recorded) as the sample images since the sample images are used for comparison. In the present embodiment, the sample images are printed in the same area as the test pattern image since where they are printed is not so important. However, it is also possible that they are located in other areas, respectively, or that the test pattern in the first area is compared with the sample images in the second area skipping printing of the sample images in the first area.

Figure 12:
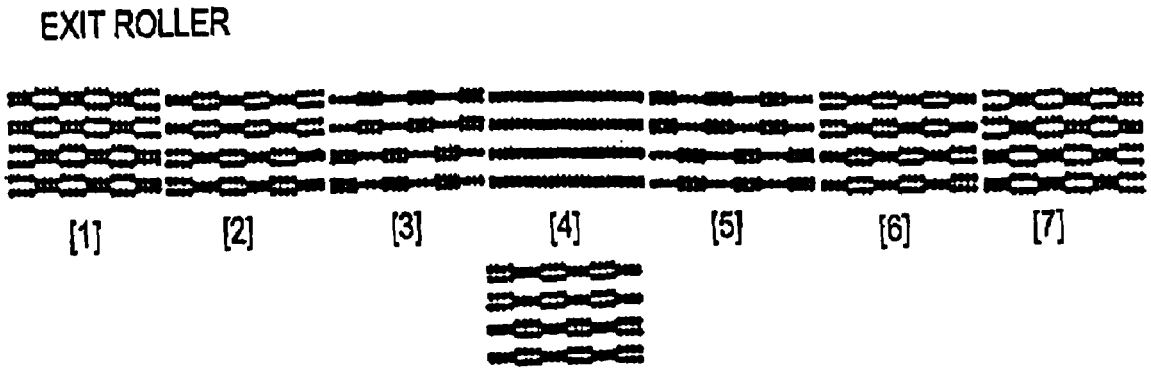
FIG. 12 is an explanatory view showing the sample images and test pattern image printed in a second area.

In step S470, the a message which invites an input of the number of the test pattern image which most closely resembles the test pattern image (test pattern image in which the error in the amount transferred by the LF roller 18 is reflected) printed in the first area on the paper P in step S420 is displayed on the display of the operation panel 30. Since two test pattern images are printed on the paper P, it is preferable that a legend as well is printed on the paper, which indicates that the test pattern image in the first area printed in step S420 is for correction of the LF roller 18 and that the test pattern image in the second area printed in step S460 is for correction of the exit roller 20, so that the respective test pattern images can be distinguished from each other For example, FIG. 12 shows the sample images and test pattern image printed in the second area. The legend "EXIT ROLLER" is printed above the sample images.

In step S480, the CPU 44 stands by until the input by the operator using the input keys of the operation panel 30 is received. When the operator performs the input operation, the process moves to step S490, and the correction value 50*a* for LF roller 18 stored in the EEPROM 50 is replaced with the optimal value based on the inputted number. That is, as mentioned above, if there is an error (over and short) in the transfer amount of the paper P when the test pattern is printed, the pattern which appears in the test pattern image varies depending on the degree of error. Therefore, it is possible to determine the degree of error in the transfer amount based on the number of the sample image which most closely resembles the test pattern image, and set the optimal correction value based on the inputted number.

In step S500, as is the case with the above step S470, a message which invites an input of the number of the test pattern image which most closely resembles the test pattern image (test pattern image in which the error in the amount transferred by the LF roller 18 is reflected) printed in the second area of the paper P in step S450 is displayed on the display of the operation panel 30.

In step S510, the CPU 44 stands by until the input by the operator using the input keys of the operation panel 30 is received. When the operator performs the input operation, the process moves to step S520, and the correction value 50*b* for exit roller 20 stored in the EEPROM 50 is replaced with the optimal value based on the inputted number.

Figure 13:
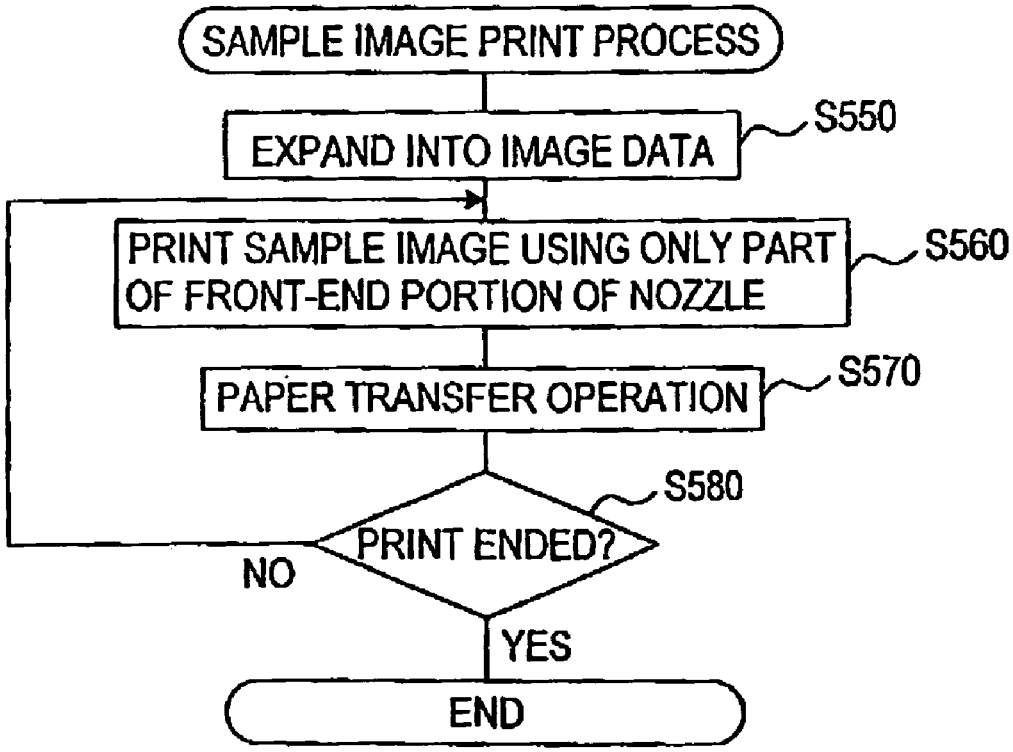
FIG. 13 is a flowchart of a sample image print process.

Next, the sample image print process executed in steps S410 and S440 of the aforementioned correction value setting process is explained by way of a flowchart of FIG. 13. The sample image data 46*a* is stored in the ROM 46 in advance.

When this sample image print process is started, in step S550, the sample image data 46*a* stored in the ROM 46 is read to expand the sample image into image data.

In step S560, the CPU 44 activates the carriage motor 38 to print the sample images on the paper P, using only part of nozzles 22*a* located on a downstream side in the transfer direction of paper in the nozzle group 22*b* of the record head 22. A plurality of sample images are printed side by side in the primary scanning direction.

In step S570, the paper P is transferred by an amount necessary to print the images. If the printing of the sample images is not completed (S580: NO), the process returns to step S560 to continue printing. If the printing of the sample images is complete (S580: YES), the sample image print process is ended.

If line-by-line printing by means of only a single nozzle and transferring of the paper P are repeated, the error in transferring of the paper is not remarkable and reproducibility of the image becomes high. However, use of the single nozzle requires enormous time for printing, and thus a plurality of nozzles 22*a* are used here. The nozzles 22*a* to be used for printing can be any part of the nozzle group 22*b*. However, it is preferable that a continuous part of the nozzles are used.

As above, printing of the plurality of sample images in the primary scanning direction on the paper P allows minimization of the area required for printing the sample images. Therefore, it is possible, for example, to print the plurality of sample images within the second area which is narrow in the secondary scanning direction.

Furthermore, printing of the sample images in the neighborhood of the respective test pattern images allows easy comparison of the test pattern images and sample images.

In the ink jet printer 10 of the above embodiment, one test pattern image is printed for each of the LF roller 18 and exit roller 20, and the transfer amount is corrected based on the test pattern image. However, it is also preferable that a plurality of test pattern images are printed in each of the first and second areas on the paper P in different phases of the rollers 18, 20, and the transfer amount may be corrected based on the plurality of test pattern images. This is because, in case that rotation shafts of the LF roller 18 and exit roller 20 are eccentric, the transfer amounts may differ according to the rotating positions.

Figure 11:
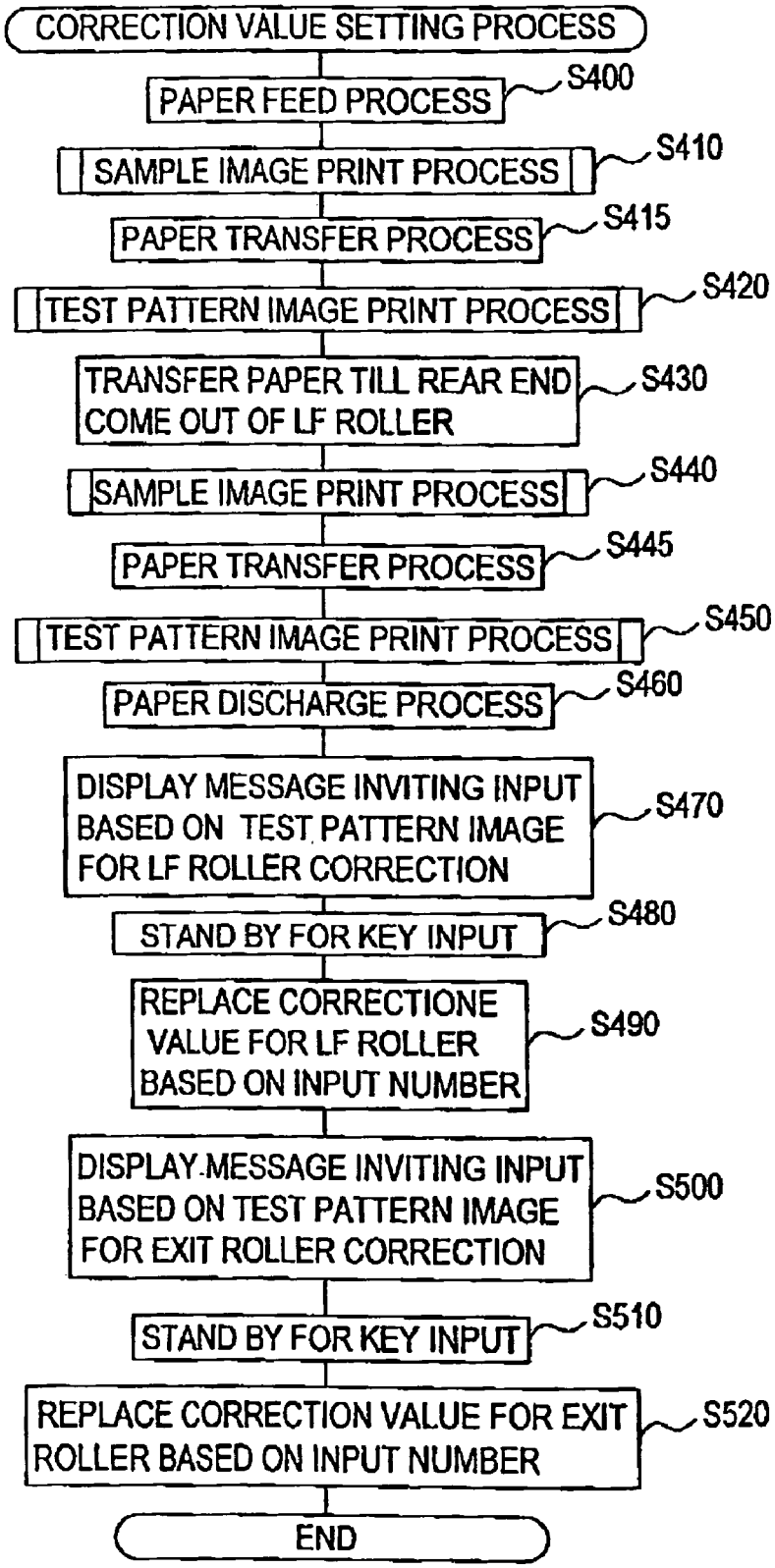
FIG. 11 is a flowchart of the correction value setting process when the sample image is printed on a paper.

Particularly, to realize the above, a correction value setting process shown in FIG. 11 is executed instead of the correction value setting process (FIG. 8) of the above embodiment.

That is, when this correction value setting process is started, the CPU 44 rotates the respective rollers 16, 18, 20 to transfer the paper P on the paper tray 12 to a position in which the test pattern image can be printed in the first area of the paper P in step S600.

In step S610, the aforementioned sample image print process (FIG. 13) for printing the sample images in the first area of the paper P is executed.

In step S615, the CPU 44 rotates the respective rollers 18, 20 to transfer the paper P by a predetermined amount (as much amount as to create an interval between the sample images and the test pattern image), and in step S620, executes the aforementioned test pattern image print process (FIG. 9) for printing the test pattern image in the first area of the paper P.

In step S630, the paper P is transferred by a half rotation of the LF roller 18 (180° rotation), and in step S640, executes the test pattern image print process again.

In step S650, the CPU 44 rotates the respective rollers 18, 20 to transfer the paper P to a position in which the test pattern image can be printed in the second area (position in which the rear end of the paper P comes out of the LF roller 18).

In step S660, as is the case with step S610, the sample image print process for printing the sample images in the second area of the paper P is executed.

In step S665, the paper P is transferred by a predetermined amount (as much amount as to create an interval between the sample images and the test pattern image), and in step S670, the test pattern image print process for printing the test pattern image in the second area of the paper P is executed as in step S620.

In step S680, the paper P is transferred by a half rotation of the exit roller 20, and the test pattern image print process is executed again in step S690.

In step S700, the CPU 44 rotates the exit roller 20 to transfer the paper P onto the not shown exit tray. As a result, the paper P on which the sample images and two test pattern images spaced in the secondary scanning direction are printed in two areas is discharged. That is, a set of the sample images and two test pattern images disposed in the secondary scanning direction are respectively printed in the first area and in the second area of the paper P.

In step S710, a message which invites an input of the number of the sample image which most closely resembles the test pattern image (FIG. 7) printed in the first area on the paper P (hereinafter, referred to as a first test pattern image for LF roller correction) in step S620 is displayed on the display of the operation panel 30.

In step S720, the CPU 44 stands by until the input by the operator using the input keys of the operation panel 30 is received. When the operator performs the input operation, the process moves to step S730 and a message which invites an input of the number of the sample image which most closely resembles the test pattern image printed in the second area of the paper P (hereafter, referred to as a second test pattern image for LF roller correction) in step S640 is displayed on the display of the operation panel 30.

In step S740, the CPU 44 stands by until the input by the operator using the input keys of the operation panel 30 is received. When the operator performs the input operation, the process moves to step S750, and the correction value 50*a* for LF roller 18 stored in the EEPROM 50 is replaced with the optimal value based on an average value of the number inputted with respect to the first test pattern image for LF roller correction and the number inputted with respect to the second test pattern image for LF roller correction.

In step S760, as is the case with the above step S710, a message which invites an input of the number of the sample image which most closely resembles the test pattern image printed in the second area of the paper P (hereinafter, referred to as a first test pattern image for exit roller correction) in step S670 is displayed on the display of the operation panel 30.

In step S770, the CPU 44 stands by until the input by the operator using the input keys of the operation panel 30 is received. When the operator performs the input operation, the process moves to step S780 and a message which invites an input of the number of the sample image which most closely resembles the test pattern image printed in the second area of the paper P (hereafter, referred to as a second test pattern image for exit roller correction) in step S670 is displayed on the display of the operation panel 30.

In step S790, the CPU 44 stands by until the input by the operator using the input keys of the operation panel 30 is received. When the operator performs the input operation, the process moves to step S800, and the correction value 50*b* for LF roller 18 stored in the EEPROM 50 is replaced with the optimal value based on an average value of the number inputted with respect to the first test pattern image for exit roller correction and the number inputted with respect to the second test pattern image for exit roller correction.

In this manner, even if the rotation shafts of the rollers 18, 20 are eccentric, appropriate correction can be done. It is also possible to print three test pattern images having intervals of 120° rotation of the rollers 18, 20. The more test pattern images are printed, the more appropriate correction can be made.

In the ink jet printer 10 of the above embodiment, the sample images having serial numbers of [1] to [7] are referred to, and the input of the serial number is invited. However, the test pattern images having numbers like [1], [3], [5], . . . may be printed on the paper P, and the ink jet printer 10 may be designed to accept not only the printed numbers but the intermediate numbers (such as [2], [4]). The correction based on not only the serial numbers but also the intermediate numbers allows more precise correction.

In the above embodiment, the test pattern image composed of the first pattern image (FIG. 5) and second pattern image (FIG. 6) is used as an example. However, the test pattern image can be generated by narrowing the interval in the secondary direction between the first and second pattern images so that the higher the degree of misalignment may be, the clearer checkered pattern, from a microscopic viewpoint, emerges. The test pattern image may be generated in such a way that the degree of misalignment can be determined by change of colors.

What is claimed is:

1. An image forming apparatus provided with a transfer unit and a record head having a plurality of record elements arranged thereon for recording dots on a recording material, the apparatus forming an image on the recording material based on a transfer operation for making the transfer unit transfer the recording material and a move operation for making the record head travel to a direction orthogonal to a transfer direction of the recording material, the image forming apparatus comprising:

a pattern generation unit that generates a predetermined test pattern image;

a record unit that records the test pattern image generated by the pattern generation unit on the recording material transferred by the transfer unit using the record head;

an input unit which inputs a result of visual comparison between the test pattern image and a plurality of sample images prepared based on change in the transfer condition of the transfer unit; and a correction unit that corrects the transfer condition of the transfer unit based on the comparison result received via the input unit.

2. The image forming apparatus as set forth in claim 1 wherein the plurality of sample images are comprised of images expected to be obtained when the test pattern images generated by the pattern generation unit are recorded by the record unit under an optimal transfer condition of the transfer unit and under conditions different from the optimal transfer condition by predetermined values, and the sample image is divided into a plurality of segments per transfer condition.

3. The image forming apparatus as set forth in claim 2 wherein a command value indicating which of the plurality of segments in the sample images the recorded test pattern image corresponds to or falls between is inputted via the input unit, and the correction unit calculates the optimal transfer condition based on the command value to correct the transfer condition.

4. The image forming apparatus as set forth in claim 3 further comprising a nonvolatile transfer condition storage unit that stores the transfer condition, wherein the optimal transfer condition calculated by the correction unit is stored in the transfer condition storage unit.

5. The image forming apparatus as set forth in claim 1 further comprising a sample generation unit that generates the plurality of sample images based on the plurality of transfer conditions of the transfer unit, wherein the record unit records the test pattern image generated by the pattern generation unit and the sample images generated by the sample generation unit on the recording materials transferred by the transfer unit using the record head.

6. The image forming apparatus as set forth in claim 5 wherein the record unit records the sample images with limiting the record elements of the record head used for recording or records the sample images with the transfer amount of the recording material less than normal.

7. The image forming apparatus as set forth in claim 6 wherein the record unit records the plurality of sample images on the recording material side by side in a moving direction of the record head.

8. The image forming apparatus as set forth in claim 1 wherein the test pattern image recorded on the recording material by the record unit is composed of a first pattern image and a second pattern image which are recorded on the recording material one by one, the recording material being transferred between the recordings of two pattern images, and the record unit records the first pattern image using a first part of the record elements of the record head, and records the second pattern image using a second part of the record elements which is different from the first part in position in the transfer direction of the recording material.

9. The image forming apparatus as set forth in claim 8 wherein the first part and the second part correspond to respective end parts of the record elements of the record head in the transfer direction of the recording material.

10. The image forming apparatus as set forth in claim 1 wherein the record elements of the record head eject ink drops to form dots on the recording material, and the record control unit records the test pattern image on the recording material only when the record head is moved to one predetermined direction.

11. The image forming apparatus as set forth in claim 1 wherein the test pattern image is an image having a pattern which varies depending on the error in the amount transferred by the transfer unit.

12. The image forming apparatus as set forth in claim 1 wherein the transfer unit comprises an upstream transfer roller that transfers the recording material on an upstream side of the record head and a downstream transfer roller that transfers the recording material on a downstream side of the record head, the record unit records the test pattern image in an area of the recording material in which the recording material is transferred only by the downstream transfer roller, and the correction unit corrects the amount transferred by the downstream transfer roller.

13. The image forming apparatus as set forth in claim 12 wherein the record unit records the test pattern image in the area in which the recording material is transferred by the upstream transfer roller, and the correction unit comprises:

a first correction unit that corrects the transfer condition of the upstream transfer roller based on information obtained by comparing the test pattern image recorded in the area in which the recording material is transferred by the upstream transfer roller with the sample images; and a second correction unit that corrects the transfer condition of the downstream transfer roller based on information obtained by comparing the test pattern image recorded in the area in which the recording material is transferred by the downstream transfer roller with the sample images.

14. The image forming apparatus as set forth in claim 13 wherein the record control unit records at least two test pattern images in different phases of at least one of the transfer rollers.

15. The image forming apparatus as set forth in claim 1 wherein the transfer unit is a device that is driven by a drive motor and, the transfer condition corresponds to a command value to the drive motor required for transferring the recording material by a predetermined distance.

16. The image forming apparatus as set forth in claim 15 wherein the drive motor is a pulse motor, and the command value is a rotation pulse number of the pulse motor.

17. A correction method of transfer condition in an image forming apparatus provided with a transfer unit and a record head having a plurality of record elements arranged thereon for recording dots on a recording material, the apparatus forming an image on the recording material based on a transfer operation for making the transfer unit transfer the recording material and a move operation for making the record head travel to a direction orthogonal to a transfer direction of the recording material, the method being for correcting the transfer condition of the transfer unit, the method comprising steps of: generating a predetermined test pattern image; recording the test pattern image generated in the pattern generation step on the recording material transferred by the transfer unit using the record head; inputting information from outside; and correcting the transfer condition of the transfer unit based on the information inputted in the input step, wherein the transfer condition of the transfer unit is corrected in the correction step by inputting as the information a result of visual comparison between the test pattern image recorded on the recording material in the recording step and a plurality of sample images prepared based on change in the transfer condition of the transfer unit.

18. The correction method of transfer condition as set forth in claim 17 wherein the sample images are comprised of images expected to be obtained when the test pattern images generated by the pattern generation unit are recorded by the record unit under an optimal transfer condition of the transfer unit and under conditions different from the optimal transfer condition by predetermined values, and the sample image is divided into a plurality of segments per transfer condition.

19. The correction method of transfer condition as set forth in claim 18 wherein the input step includes a step of inputting a command value indicating which of the plurality of segments in the sample images the recorded test pattern image corresponds to or falls between is inputted via the input unit, and the correction step includes a step of calculating the optimal transfer condition based on the command value to correct the transfer condition.

20. The correction method of transfer condition as set forth in claim 19 further comprising a step of storing the optimal transfer condition calculated in the correction step in the transfer condition storage unit.

21. The correction method of transfer condition as set forth in claim 17 further comprising a step of generating the plurality of sample images based on the plurality of transfer conditions of the transfer unit, wherein the recording step includes a step of recording the test pattern image generated in the pattern generation step and the sample images generated in the sample generation step on the recording materials transferred by the transfer unit using the record head.

22. The correction method of transfer condition as set forth in claim 21 wherein the sample images are recorded in the recording step with limiting the record elements of the record head used for recording or with the transfer amount of the recording material less than normal.

23. The correction method of transfer condition as set forth in claim 22 wherein the plurality of sample images are recorded in the recording step on the recording material side by side in a moving direction of the record head.

24. The correction method of transfer condition as set forth in claim 17 wherein the test pattern image recorded on the recording material in the recording step is composed of a first pattern image and a second pattern image which are recorded on the recording material one by one, the recording material being transferred between the recordings of two pattern images, and the first pattern image is recorded using a first part of the record elements of the record head, and the second pattern image is recorded using a second part of the record elements which is different from the first part in position in the transfer direction of the recording material in the recording step.

25. The correction method of transfer condition as set forth in claim 24 wherein the first part and the second part correspond to respective end parts of the record elements of the record head in the transfer direction of the recording material.

26. The correction method of transfer condition as set forth in claim 17 wherein the record elements of the record head eject ink drops to form dots on the recording material, and the test pattern image is recorded in the recording step on the recording material only when the record head is moved to one predetermined direction.

27. The correction method of transfer condition as set forth in claim 17 wherein the test pattern image is an image having a pattern which varies depending on the error in the amount transferred by the transfer unit.

28. The correction method of transfer condition as set forth in claim 17 wherein the transfer unit comprises an upstream transfer roller that transfers the recording material on an upstream side of the record head and a downstream transfer roller that transfers the recording material on a downstream side of the record head, the test pattern image is recorded in the recording step in an area of the recording material in which the recording material is transferred only by the downstream transfer roller, and the amount transferred by the downstream transfer roller is corrected in the correction step.

29. The correction method of transfer condition as set forth in claim 28 wherein the test pattern image is recorded in the recording step in the area in which the recording material is transferred by the upstream transfer roller, and the correction step comprises steps of:

correcting the transfer condition of the upstream transfer roller based on information obtained by comparing the test pattern image recorded in the area in which the recording material is transferred by the upstream transfer roller with the sample images; and correcting the transfer condition of the downstream transfer roller based on information obtained by comparing the test pattern image recorded in the area in which the recording material is transferred by the downstream transfer roller with the sample images.

30. The correction method of transfer condition as set forth in claim 29 wherein at least two test pattern images are recorded in the recording step in different phases of at least one of the transfer rollers.

* * * * *